US007510028B2

(12) United States Patent
Welsh

(10) Patent No.: US 7,510,028 B2
(45) Date of Patent: Mar. 31, 2009

(54) DRILL PIPE RACKING APPARATUS

(76) Inventor: Walter Thomas Welsh, 510 Farmington Dr., Lafayette, LA (US) 70510

( * ) Notice: Subject to any disclaimer, the term of this patent is extended or adjusted under 35 U.S.C. 154(b) by 84 days.

(21) Appl. No.: 11/510,460

(22) Filed: Aug. 24, 2006

(65) Prior Publication Data

US 2008/0047752 A1 Feb. 28, 2008

(51) Int. Cl.
*E21B 19/14* (2006.01)
*E21B 19/24* (2006.01)

(52) U.S. Cl. ..... 175/52; 175/85; 414/22.68

(58) Field of Classification Search ..... 175/57, 175/52, 85; 414/22.63, 22.68, 22.51; 211/70.4
See application file for complete search history.

(56) References Cited

U.S. PATENT DOCUMENTS 2,628,725 A * 2/1953 Stone ..... 414/22.63
3,768,663 A * 10/1973 Turner et al. ..... 211/70.4
3,799,364 A * 3/1974 Kelly et al. ..... 414/22.71
3,870,165 A * 3/1975 Besijn ..... 414/22.71
4,397,605 A * 8/1983 Cowgill et al. ..... 414/22.71
4,709,766 A * 12/1987 Boyadjieff ..... 175/52
4,725,179 A * 2/1988 Woolslayer et al. ..... 414/22.65
4,738,321 A 4/1988 Olivier
4,765,401 A * 8/1988 Boyadjieff ..... 166/77.53
4,862,973 A * 9/1989 Voigts et al. ..... 175/52
6,821,071 B2 11/2004 Woolslayer et al.
7,083,007 B2 * 8/2006 Herst ..... 175/52
7,246,983 B2 * 7/2007 Zahn et al. ..... 414/22.65
7,331,746 B2 * 2/2008 Wright et al. ..... 414/22.65

* cited by examiner

*Primary Examiner*—Shane Bomar
(74) *Attorney, Agent, or Firm*—John D. Jeter

(57) ABSTRACT

Lower pipe stand racking combs are arranged to fold down from a side of the derrick at selected locations above the rig floor. In each racking comb an array of parallel fingers extend in a spaced array from a pivotable spine. The spine rotates to raise the fingers to a near vertical position to clear the rig floor activity area. A suspended pipe stand can pass laterally from the well center line past the ends of the fingers. The fingers, each, have a retractable extension that, when extended, will prevent the suspended pipe stand from passing the extended finger. The stopped pipe stand can then move transversely into the selected space between two fingers. Each finger extension has independent fluid power supply and control lines, the collection of the lines may extend to a control and power source selectively positioned on the rig floor or derrick. Raising of each comb assembly is, preferably, done by a fluid power cylinder attached to the derrick structure and to each comb assembly. Fluid power to actuate and control the comb raising cylinders is conducted by lines leading to a selected location on the drilling rig structure.

16 Claims, 3 Drawing Sheets

DRILL PIPE RACKING APPARATUS

This invention relates to the equipment used to aid the mechanized handling of drill pipe during the racking of the drill string as it is removed from a well.

BACKGROUND

During the drilling of petroleum related wells the drill string is occasionally removed from the well bore, and re-installed in the well bore. That activity is referred to as tripping the string. It is effectively a round trip. Drilling floor activity is a dangerous process and most injuries occur during the tripping activity.

Considerable effort has been made to mechanize the tripping process. Part of the effort has been directed to separating the drill string from operating personnel. The drill pipe is normally broken into stands of two or three joints each and racked, standing on end, in the drilling rig at two areas of the drilling floor. On most large drilling rigs, a bridge crane type racking system, incorporating a hoist, moves horizontally in two mutually perpendicular directions to positively position the upper end of a stand being racked. The lower end of the stand, however, tends to swing and movement of the upper end only slowly controls the lower end. It tends to swing about. Drilling floor personnel normally control the lower end until it is properly placed in the racking area. That personal contact, all too often results in injuries.

Efforts to reduce human contact with the lower end of a pipe stand, have brought manipulators into practice to position the lower end of the stand being moved to racks. The manipulators are powered and operated somewhat like a back hoe. They reach in from the side of the drilling floor, grasp the lower end of the stand, and move it to the desired position. They are powered and effective but they are costly, take up needed space, and they are manned. The man is still at risk.

With the drill racking in progress, the drilling floor becomes crowded. Drill string manipulation machines do not have an open area in which to function. Power tongs have to operate in the area that would be needed for some forms of pipe manipulation machines.

There is a need for controllable drill pipe racking aids that do not stand on the drilling floor. When the drill pipe is in the well bore, and drilling activity is underway, it is advantageous to remove the racking aids from the area they necessarily occupy during tripping. The present invention addresses that problem.

The upper end of the racks of drill pipe stands have customarily been organized and controlled by combs that separate the individual banks of standing drill pipe. They have worked quite well in the past. Such combs should work well to organize and control the lower ends in a similar fashion. The control of the upper ends of pipe will not insert the lower end of the pipe in the combs because of the pendulum swing common to the lower end. Any racking aid has to aid the swinging pipe in finding the proper route into the lower combs. If lower combs are used they have to have special features not required of the upper combs. Such features are disclosed herein.

SUMMARY OF THE INVENTION

A lower comb has a retractable extension in each finger that can be extended into the normal path of the pipe stand being moved into position by the overhead hoist so that the swinging stand is stopped in alignment with the receiving finger. All finger extensions nearer the well have to be withdrawn to allow the moving pipe to proceed to the receiving finger. The extensions are, preferably, extended telescopically from the finger by a power cylinder housed within the finger.

The lower comb would present an obstruction to the many hoisting and manipulating actions that take place when the lower comb is not needed. The comb can be hingedly secured to the derrick side and when it is not needed it can fold upwardly against the derrick side. The folding action can be accomplished by power cylinders that act between the comb and the derrick. The folding action could be accomplished by common hoisting means normally abundant in a drilling rig derrick.

The finger extensions could be hinged to fold down from the end of the finger, and be extended by a power cylinder in, or on, the finger but the telescoping action and the finger housed power cylinder is preferred.

The comb assembly is, preferably, situated on a committed frame that can be positioned selectively on the derrick. The vertical height from the rig floor may need to be selectively positioned to accommodate apparatus needed on the rig floor, the frame is optional but is shown on the drawings.

These and other objects, advantages, and features of this invention will be apparent to those skilled in the art from a consideration of this specification, including the attached claims and appended drawings.

BRIEF DESCRIPTION OF DRAWINGS

FIG. 1 is a side view, truncated, of a symbolic derrick, with combs in place.

FIG. 2 is a plan view of a symbolic rig floor, with the lower combs in place.

DETAILED DESCRIPTION OF DRAWINGS

In the formal drawings, some features that do not bear upon points of novelty and are common to those skilled in the art of machine construction are omitted in the interest of descriptive clarity. Weld lines, threaded junctions, pins, threaded fasteners, and the like are omitted.

Figure 1:
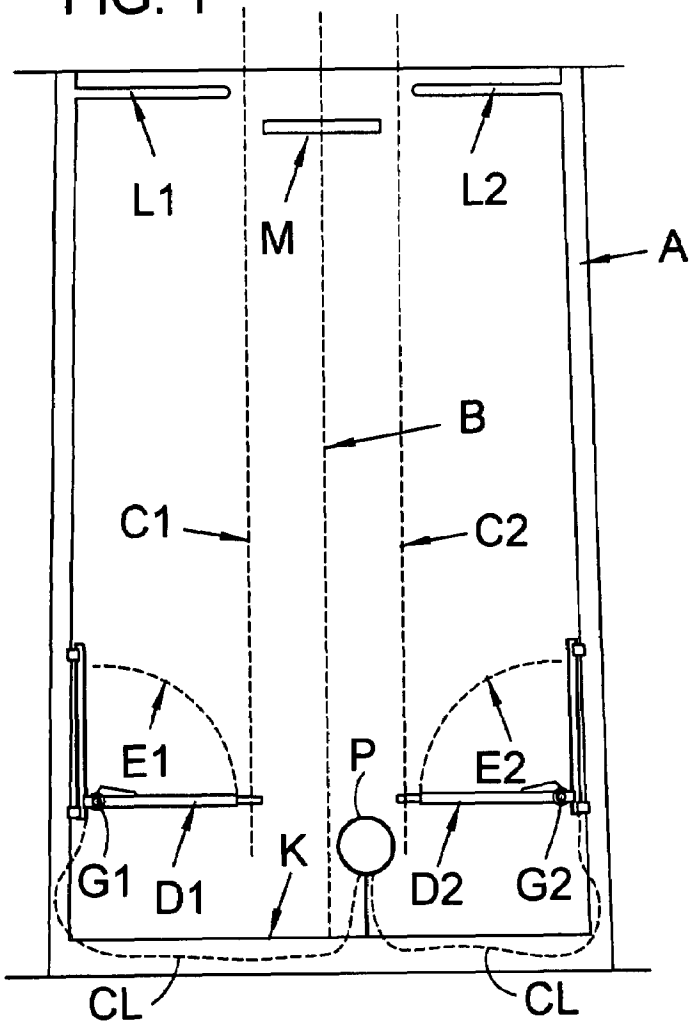

FIG. 1 shows derrick A, center line of a suspended pipe stand B, rig floor K, the foldable comb assemblies D1 and D2, and the arc of the ends of the folding fingers E1 and E2. The separated pipe stands are moved to lines C1 or C2 by the racking hoist in preparation for movement to the racking areas. The rigs now in use have the monkey board M, and racking fingers L1 and L2. In future use, men will not likely work on the monkey board, while racking pipe, but it will likely remain in place. Control lines CL (note 3*b* & 12, FIGS. 4 and 6) lead to a selected position P.

Figure 2:
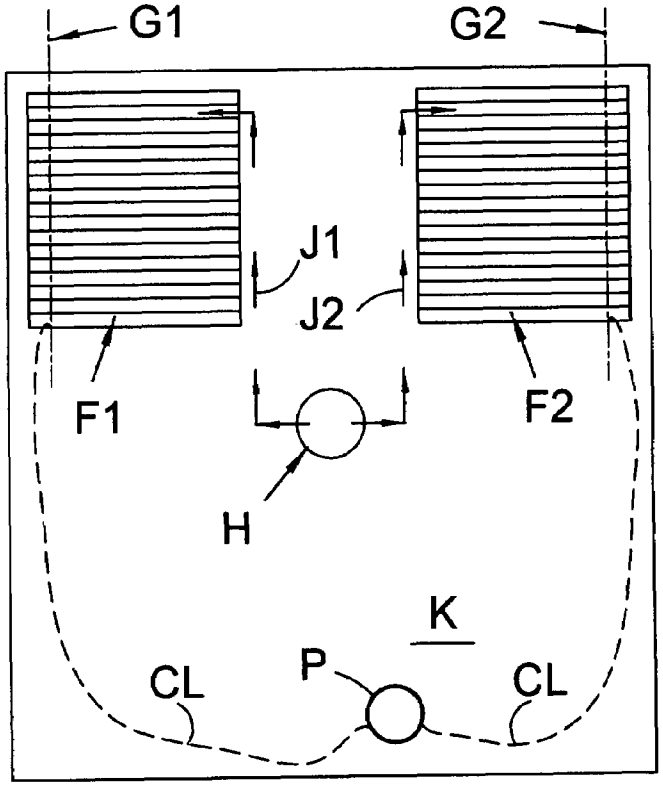
FIGS. 1 and 2 are intended only to show the relationship between the novel comb arrangement relative to the derrick and the rig floor. Only the pivot axis of the comb and the lines of expected movement of pipe stands being racked are related to details of construction illustrated by other Figs. supplied.

FIG. 2 shows a symbolic rig floor K, symbolic rotary table H, the comb assembly areas F1 and F2, the pivot axis of the foldable combs G1 and G2, and paths J1 and J2 traversed by a suspended pipe stand.

Figure 3:
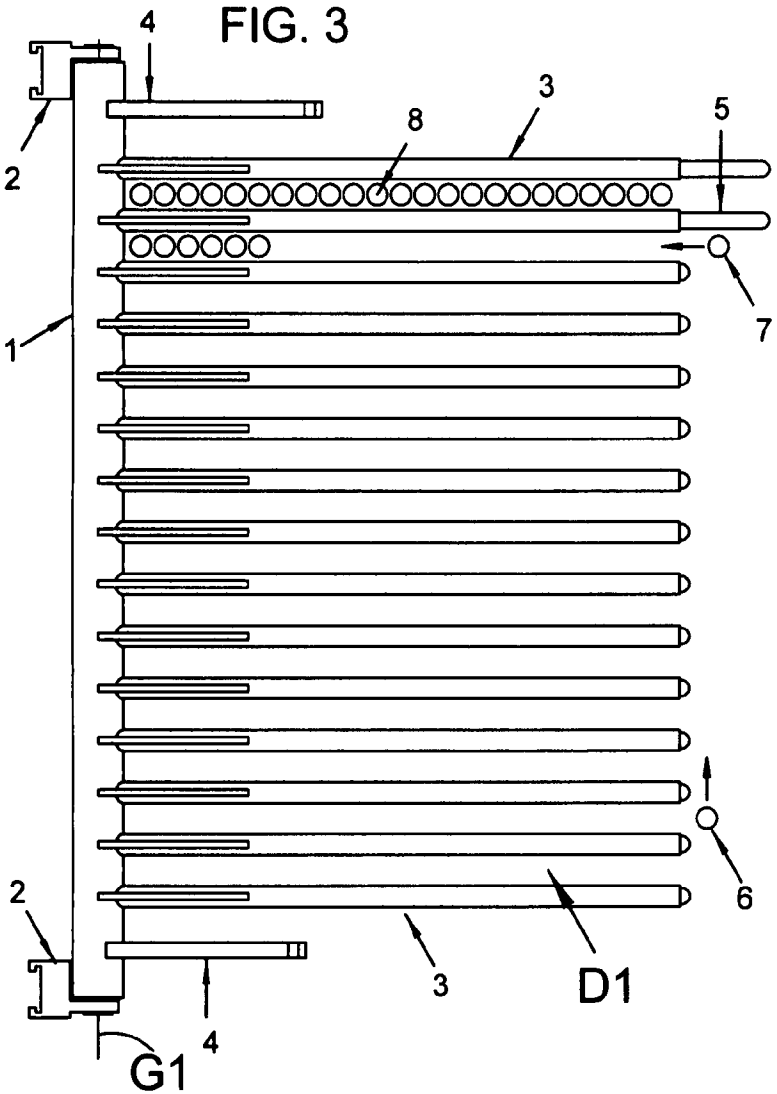
FIG. 3 is a top view of the comb assembly, minus folding power cylinders.

FIG. 3 shows the typical comb assembly. Spine 1 is pivotally supported by brackets 2, which attach to an adjustment frame (not shown), fingers 3 which are welded to the spine, lifting and control levers 4 which are welded to the spine, the telescopic extensions 5, a pipe stand 6, moving along the path for stacking, the same pipe stand 7 engaging an extension 5, and several stands 8 of pipe already in the racked position. The extensions 5 are extended, in their turn, to stop the movement of the next stand when a previously loaded finger carries its limit of stands.

Figure 4:
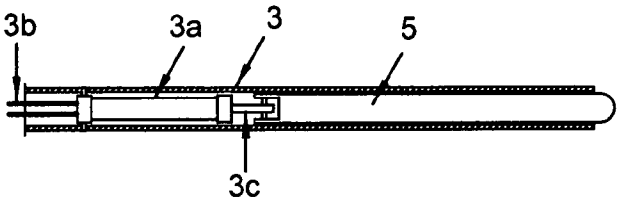
FIG. 4 is a side view, mostly cut away, and somewhat enlarged, of the preferred individual extension finger mechanism. They shown retracted.

FIG. 4 shows one finger 3, in cut away, with power cylinder 3*a* (a linear motor) secured within the finger connected to finger extension 5 by rod 3*c*. Power is supplied by tubes 3*b*.

Figure 5:
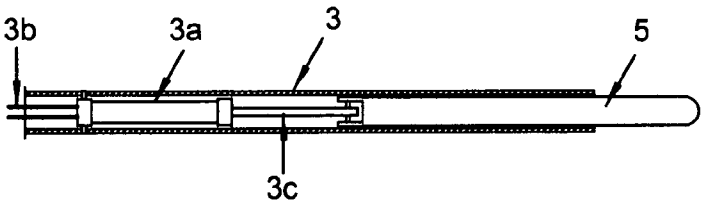
FIG. 5 is the same as FIG. 4, but with the finger extension advanced.

FIG. 5 is identical to FIG. 4 but the power cylinder has extended extension 5 from the end of the finger. The fluid power needed to extend each finger is supplied from a location of choice, individually through lines 3*b*, collectively through lines 12 of FIGS. 5 and 6. To remote locations the collection of lines are CL, FIG. 1.

Figure 6:
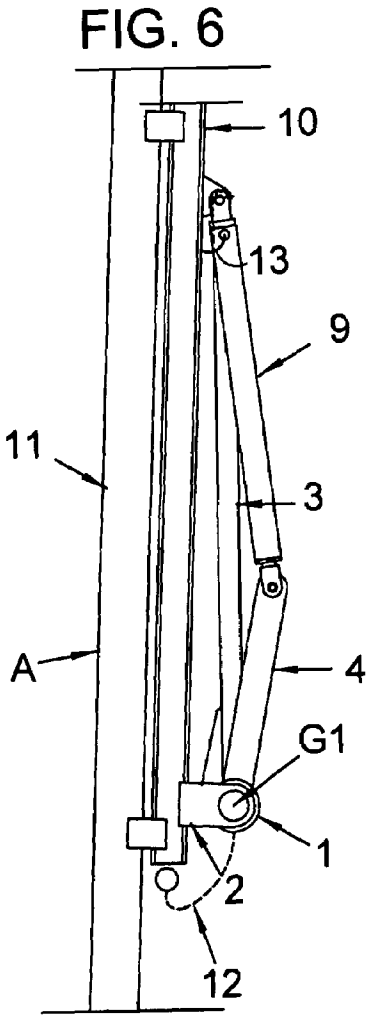
FIG. 6 is a side view of the comb assembly, folded upward against a side of the derrick.

FIG. 6 shows the comb assembly in the folded position. Spine 1 rotates about the axis G1 (see FIG. 1) to fold and deploy. Brackets 2 are shown attached to a committed frame 10 which may be variably positioned and secured to the derrick structure 11. Optionally, brackets 2 may be secured directly to the derrick structure 11. Positioning and control cylinder 9 is shown secured to the frame 10. In the absence of frame 10, the cylinder would be secured to the derrick structure. The fluid power for each cylinder 3*a*, lines 3*b*, is supplied by the manifold and lines, shown symbolically as 12. Lines 13 to cylinder 9 may be included in line collection CL of FIGS. 1 and 2.

Figure 7:
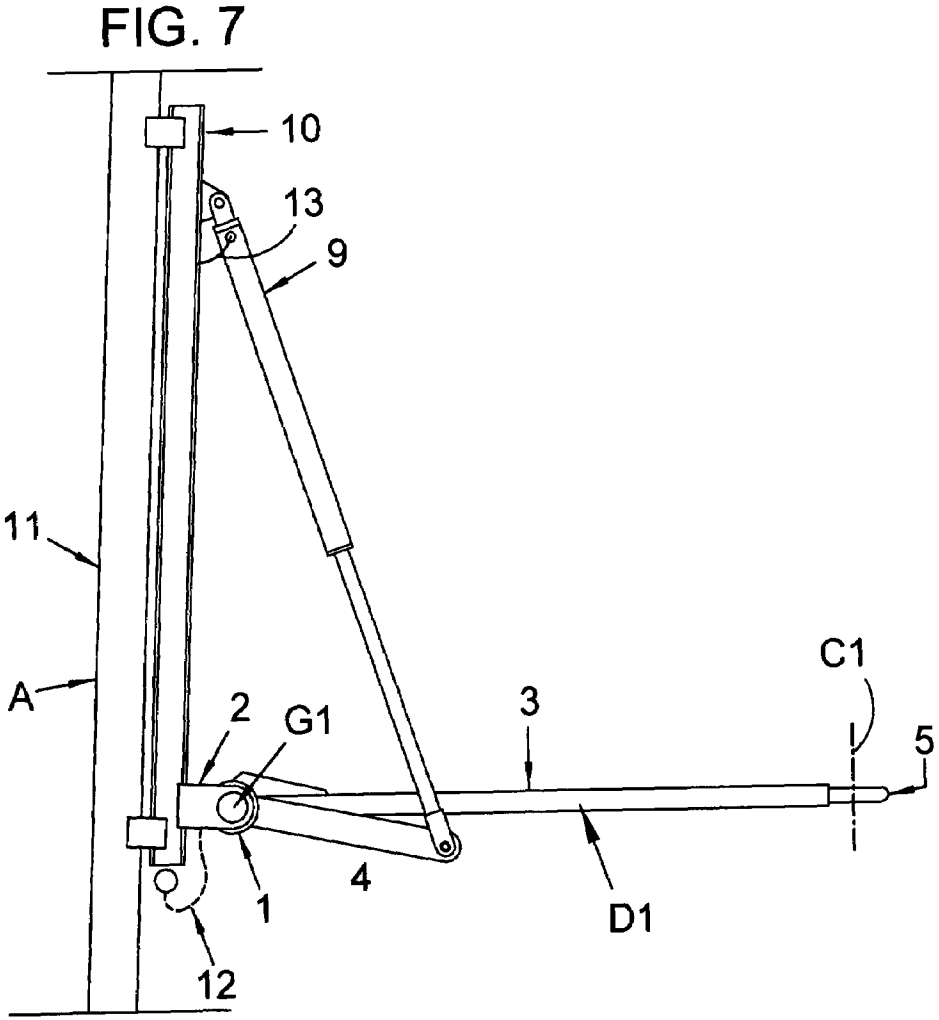
FIG. 7 is a view similar to FIG. 6, but the comb is pivoted to the pipe racking position.

FIG. 7 is identical to FIG. 6, but in the deployed position. The caption D1 represents the overall finger assembly, caption 3 is the specific finger shown. Finger extension 5 is shown extended.

Motors, as defined herein may include rotary or linear motors, either electric or fluid powered.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

I claim:

1. A pipe stand racking apparatus for aligning the lower end of pipe stands being racked, in the standing position, on a drilling rig floor, the apparatus comprising:

a) a racking comb assembly comprising a plurality of parallel fingers rigidly connected to a spine, said spine pivotally supported on a structure of said drilling rig for selectively positioning the fingers generally parallel with the drilling rig floor and foldable to a generally vertical position; and b) each said finger provided with a retractable and extendable finger extension that, when extended, engages pipe stands moving to a racking area, directing the engaged pipe stands to move along each said finger, and when retracted allows the pipe stand to pass the finger unimpeded.

2. The apparatus of claim 1 wherein each said finger extension is provided with a remotely controlled motor for extending and retracting the finger extension.

3. The apparatus of claim 1 wherein said racking comb assembly is provided with a remotely controlled motor situated to selectively raise the comb assembly to the vertical position and to lower it to the generally parallel position.

4. The apparatus of claim 1 wherein said racking comb assembly is secured to a frame, the frame arranged for selective positioning on the rig structure.

5. The apparatus of claim 1 wherein said finger extensions are telescopically situated in the fingers.

6. The apparatus of claim 5 wherein a motor is situated within each finger for selectively extending and retracting the related finger extension.

7. The apparatus of claim 6 wherein said motors are fluid powered linear motors with control and power lines extending to a preselected position on the drilling rig for individual actuation.

8. The apparatus of claim 1 wherein said fingers are spaced such that one, and only one said pipe stand, defines the space between the fingers, to avoid mis-racking of pipe stands.

9. A pipe stand racking apparatus for aligning the lower end of pipe stands being racked, in the standing position, on a drilling rig floor, the apparatus comprising:

a) a racking comb assembly comprising a plurality of parallel tubular fingers rigidly connected to a tubular spine, said spine pivotally supported on a drilling rig structure for selectively positioning the fingers generally parallel with the drilling rig floor and foldable to a generally vertical position; and b) each said finger provided with a retractable and extendable finger extension that, when extended, engages pipe stands moving to a racking area, directing the engaged pipe stands to move along each said finger, and when retracted allows the pipe stand to pass the finger unimpeded.

10. The apparatus of claim 9 wherein each said finger extension is provided with a remotely controlled motor for extending and retracting the finger extension.

11. The apparatus of claim 9 wherein said racking comb assembly is provided with a remotely controlled motor situated to selectively raise the comb assembly to the vertical position and to lower it to the generally parallel position.

12. The apparatus of claim 9 wherein said racking comb assembly is secured to a frame, the frame arranged for selective positioning on the rig structure.

13. The apparatus of claim 9 wherein said finger extensions are telescopically situated in the fingers.

14. The apparatus of claim 13 wherein a motor is situated within each finger for selectively extending and retracting the related finger extension.

15. The apparatus of claim 14 wherein said motors are fluid powered linear motors with control and power lines extending to a preselected position on the drilling rig for individual actuation.

16. The apparatus of claim 9 wherein said fingers are spaced such that one, and only one said pipe stand, defines the space between the fingers, to avoid mis-racking of pipe stands.

* * * * *